US005667213A

United States Patent [19]

Chida et al.

[11] Patent Number: 5,667,213

[45] Date of Patent: Sep. 16, 1997

[54] SMALL-SIZE-SHEET STACKING UNIT AND CLEANING SHEET THEREFOR

[75] Inventors: Hiroaki Chida; Mitsuo Sato, both of Shibata-machi; Shigenobu Irokawa, Sendai, all of Japan

[73] Assignee: Tohoku Ricoh Co., Ltd., Miyagi, Japan

[21] Appl. No.: 402,605

[22] Filed: Mar. 13, 1995

[30] Foreign Application Priority Data

Jun. 15, 1994 [JP] Japan ..... 6-132856
Dec. 22, 1994 [JP] Japan ..... 6-320360

[51] Int. Cl.[6] ..... B65H 39/02

[52] U.S. Cl. ..... 270/58.03; 270/58.02; 270/58.07; 271/176; 271/179; 414/795.2

[58] Field of Search ..... 270/58.01, 58.02, 270/58.03, 58.07; 271/177, 178, 179, 212, 176; 414/795, 795.1, 795.3, 793.7; 355/322

[56] References Cited

U.S. PATENT DOCUMENTS

| | | | |
|---|---|---|---|
| 2,010,732 | 8/1935 | Mandusic | 414/793.7 |
| 2,048,870 | 7/1936 | Kannee | 271/179 X |
| 3,712,487 | 1/1973 | Eberle | 271/179 X |
| 4,108,319 | 8/1978 | Kacirek et al. | 271/212 X |
| 4,378,938 | 4/1983 | Staniszewski | 271/179 |
| 4,547,114 | 10/1985 | Watrous et al. | 271/179 X |
| 4,573,676 | 3/1986 | Miyamoto et al. | 271/179 |
| 4,968,023 | 11/1990 | Huggins et al. | 271/212 |
| 5,215,301 | 6/1993 | Oshino et al. | 271/212 |
| 5,409,206 | 4/1995 | Marzullo et al. | 271/179 |
| 5,429,349 | 7/1995 | Supron et al. | 271/179 |
| 5,480,135 | 1/1996 | Nagane et al. | 271/179 X |
| 5,544,876 | 8/1996 | Ruch | 271/179 |

FOREIGN PATENT DOCUMENTS

| | | | |
|---|---|---|---|
| 58-212502 | 12/1983 | Japan | 414/795 |
| 1-34851 | 2/1989 | Japan | 271/179 |
| 5 16514 | 1/1993 | Japan . | |
| 5 13743 | 2/1993 | Japan . | |
| 5-278959 | 10/1993 | Japan | 271/178 |

*Primary Examiner*—Hoang Nguyen
*Attorney, Agent, or Firm*—Oblon, Spivak, McClelland, Maier & Neustadt, P.C.

[57] ABSTRACT

A small-size-sheet stacking unit is attached on a printed sheet tray of a printing machine so as to receive printed sheets of small size, and is detached from the printing machine after such sheets are printed. The sheet stacking unit comprises a guide plate, a plurality of carriers for supporting side edges of a printed sheet and moving the printed sheet upward, a position sensor for detecting whether or not the printed sheet is at a position where the sheet is ready to be carried by the carriers, a driver for actuating the carriers, and a sheet receptacle for receiving the printed sheets.

13 Claims, 10 Drawing Sheets

SMALL-SIZE-SHEET STACKING UNIT AND CLEANING SHEET THEREFOR

BACKGROUND OF THE INVENTION

1. Field of the Invention

This invention relates to a sheet stacking unit disposed on a printed sheet tray of a printing machine, and more particularly to a unit for stacking small-size printed sheets such as postcards.

2. Description of the Prior Art

Stencil duplicating machines are well-known, in which an optically read original image is digitally perforated on a stencil, and the stencil is wrapped over a printing drum so that the image is printed on sheets via the stencil.

Such stencil duplicating machines are prone to a problem that when a currently printed sheet is placed on a previously printed sheet on a printed sheet tray, a rear surface of the currently printed sheet may be smeared with ink from the previously printed sheet. This phenomenon is called "back transfer". Especially, front and rear surfaces of postcards are required to be free from any smears except for the messages printed thereon. It is therefore difficult to print the postcards without back transfer. To overcome this problem, a variety of methods have been known up to now.

The following three methods have been proposed.

1. Each postcard is printed by operating a trial print key after a previously printed postcard is removed from a printed sheet tray:

2. Each postcard is printed at a slowest speed, and a slip sheet is placed on a previously printed postcard in a printed sheet tray: and 3. Each postcard is printed by each fifth rotation of a printing drum, a sheet feeding unit feeds each postcard in synchronization with the printing drum, and each printed postcard is removed from a sheet tray so as to be placed on a table or the like.

These three methods are somewhat disadvantageous because they are cumbersome and considerably time consuming.

Further, Japanese Patent Laid-Open Publication No. Hei 5-016,514 proposes a method in which printed postcards are sequentially placed on a rather long sheet feeding route between a printing drum and a printed sheet tray, so that ink penetrates into the postcards. Japanese Utility Model Laid-Open Publication No. Hei 5-013,743 exemplifies a method in which each printed sheet is carried from a printing machine to a sheet tray at a predetermined interval within a predetermined period of time.

However, a larger printing machine is necessary to provide a longer sheet feed path. If printed sheets are jammed in the sheet feed path, they cannot be removed easily. When printed sheets are carried to a printed sheet tray with a predetermined space kept between adjacent sheets, a printing machine becomes inevitably large and expensive. In this case, when a height of a sheet discharging outlet of the printing machine is taken into consideration, a sheet stacking unit should be of a floor type. This means that it is rather difficult to remove printed sheets. Further, when printing thin sheets or sheets of an ordinary size, the sheet stacking unit should be detached from the printing machine and a printed sheet tray should be attached. This detachment and attachment of the sheet stacking unit and the printed sheet tray is inconvenient.

The sheet stacking units disclosed in the foregoing Japanese laid-open publications do not include members for notifying an operator or a printing machine of any problem such as jamming or a full state of a sheet receptacle of the sheet stacking unit. Even when printed sheets are not reliably carried in the sheet stacking unit, the printing machine continues feeding subsequently printed sheets, which would gather at the sheet stacking unit and are jammed there. This means that the efficiency of the printing machine will be reduced. Further, if jamming is not detected promptly, the sheet stacking unit may be damaged. When the sheet receptacle is full, printed sheet may overflow therefrom or may be packed therein. In the latter case, back transfer may be caused on the printed sheets.

When the printing machine and the sheet stacking unit are electrically connected, at least one of them should be mechanically and electrically modified for such a connection. Such a connection is difficult to accomplish.

SUMMARY OF THE INVENTION

The present invention is aimed at providing a small-size-sheet stacking unit which can overcome the foregoing problems of the prior art units. The sheet stacking unit can carry and stack printed sheets without the occurence of back transfer, and is compact in size and inexpensive. Further, the sheet stacking unit notifies an operator or a printing machine of a full state of a sheet receptacle or problems such as jamming, thereby improving the printing efficiency of the printing machine.

According to a first aspect of the invention, each printed sheet is discharged from the printing machine onto a guide plate of a small-size-sheet stacking unit. In the sheet stacking unit, opposite side edges of the printed sheet are held by holding members of carriers. The carriers lift the printed sheet to a sheet receptacle, which is located at an uppermost part of the sheet stacking unit.

The carriers of the sheet stacking unit are cleaned by an ink-absorbing member of a cleaning sheet. Specifically, the cleaning sheet is interposed between the holding portions of the carriers.

In another aspect of the invention, a small-size-sheet stacking unit generates a signal indicating that a printed sheet is not fed to a position where the sheet is ready for being carried by the sheet stacking unit. This signal is sent to a printing machine, which stops operating accordingly.

In a further aspect of the invention, a small-size-sheet stacking unit generates a signal indicating a full state of a sheet receptacle, and provides the signal to a printing machine. The printing machine stops operating in response to this signal.

Still further, a small-size-sheet stacking unit generates a signal indicative of a full state of a sheet receptacle or a signal indicating that a printed sheet is not successfully fed to a position where the sheet is ready for being carried by the sheet stacking unit. Such a signal is provided to a printing machine so as to notify an abnormal state.

The sheet stacking unit provides the printing machine with a signal indicative of an abnormal state on a non-contact basis. The printing machine stops operating in response to such a signal.

BRIEF DESCRIPTION OF THE DRAWINGS

In all drawing figures, identical parts have identical reference numerals.

DETAILED DESCRIPTION OF THE PREFERRED EMBODIMENTS

The invention will be described with reference to a first embodiment shown in the accompanying drawings.

Figure 1:
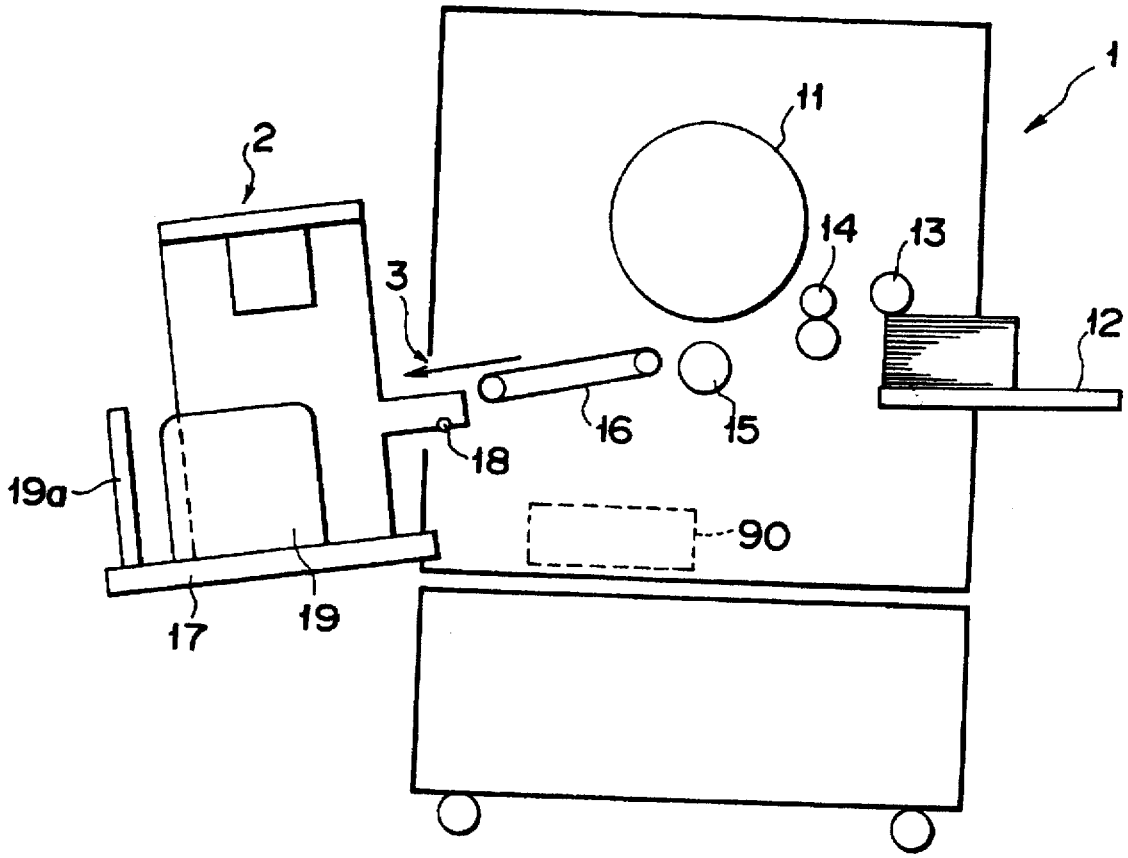
FIG. 1 is a schematic side view showing a small-size-sheet stacking unit according to a first embodiment of the invention, with the stacking unit placed on a printed sheet tray of a stencil printing machine.

Referring to FIG. 1, a sheet stacking unit 2 is attached to a stencil duplicating machine 1. The stencil duplicating machine 1 mainly comprises a printing drum 11 carrying a stencil thereon, a printing sheet tray 12, a sheet feed roller 13 for paying out printing sheets one by one, a pair of register rollers 14 for feeding each printing sheet from the sheet feed roller 13 in synchronization with the rotation of the printing drum 11, a press roller 15 for bringing the printing sheet into contact with an outer circumferential surface of the printing drum 11, printed-sheet feeding belts 16 for conveying each printed sheet, a printed sheet tray 17 for receiving printed sheets, and a controller 90 for controlling the operation of the foregoing devices. In FIG. 1, reference numeral 3 denotes a sheet outlet via which each printed sheet is discharged from the stencil duplicating machine 1, and 18 a positioning shaft for positioning the sheet stacking unit 2 on the printed sheet tray 17.

Figure 2:
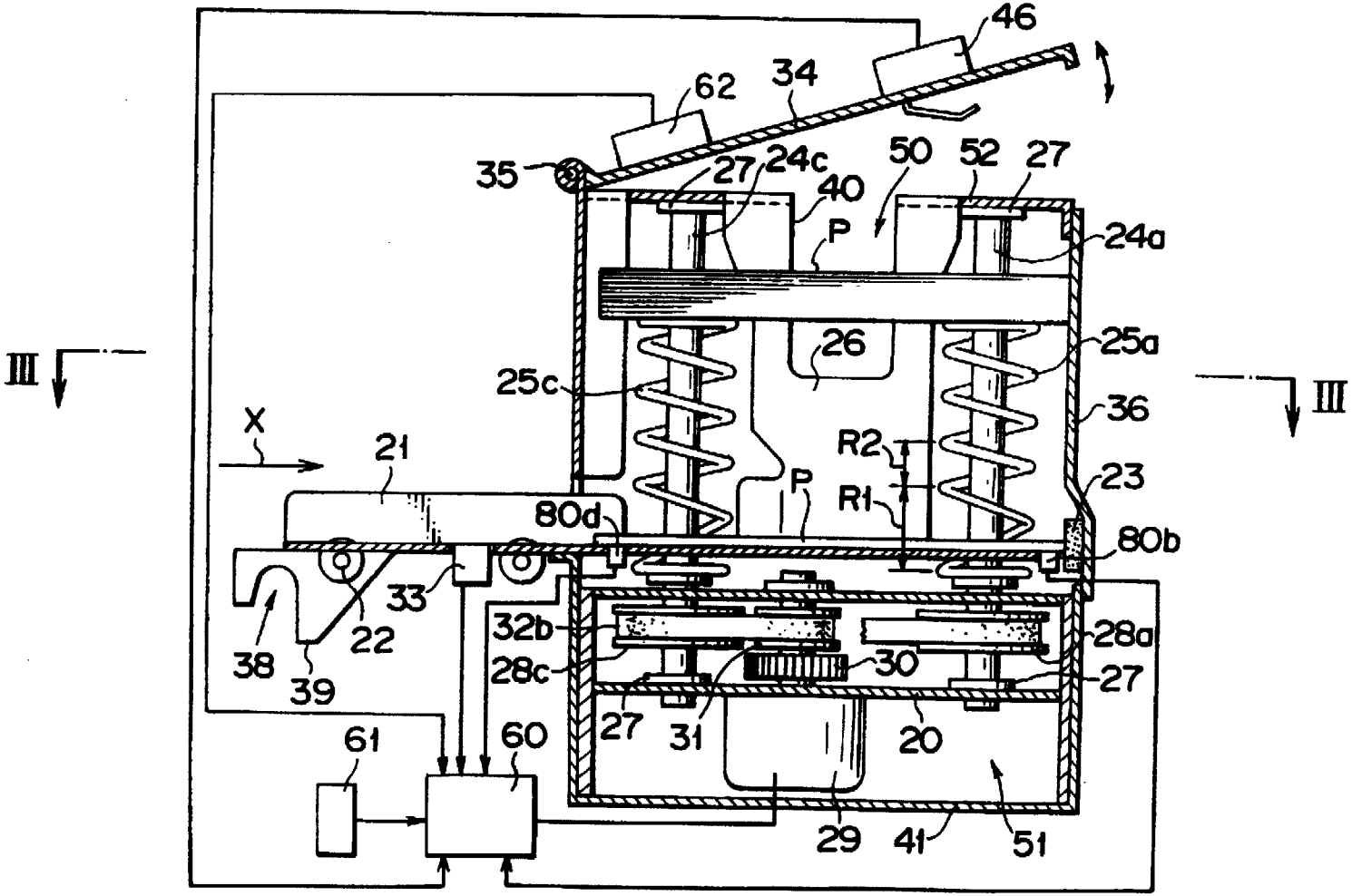
FIG. 2 shows a cross section of the sheet stacking unit.
Figure 3:
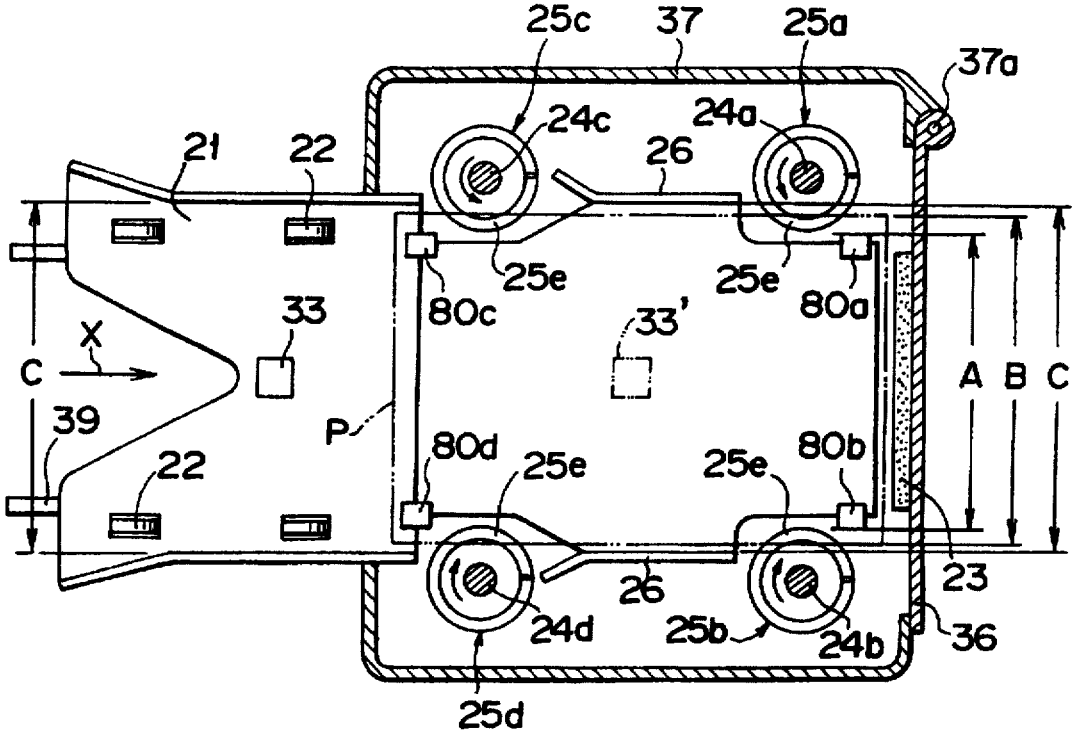
FIG. 3 is a cross-section of the sheet stacking unit, taken along line III—III in FIG. 2.

As shown in FIGS. 2 and 3, the sheet stacking unit 2 mainly comprises a guide plate 21, spiral carriers 25*a*, 25*b*, 25*c* and 25*d*, a driver 51 for operating these spiral carriers, a sheet receptacle 50, and a controller 60. The guide plate 21 guides a printed sheet P from the sheet outlet 3 in the direction X. The four spiral carriers 25*a*–25*d* stand straight up, support each printed sheet between adjacent coils 25*e* thereof, and carry the sheet upwards. Specifically, the coils 25*e* support the opposite side edges of the printed sheet P guided by the guide plate 21. The printed sheets are finally delivered to the sheet receptacle 50. The controller 60 will be described later in detail.

The guide plate 21 includes a plurality of rollers 22 so as to guide the printed sheet P smoothly, and a sensor 33 for detecting the presence of the printed sheet P. The guide plate 21 also includes position sensors 80*a*, 80*b*, 80*c* and 80*d*, which are located at positions corresponding to the four corners of the printed sheet P. These sensors provide signals to the controller 60. Alternatively, the sensor 33 may be at a position 33' surrounded by the spiral carriers 25*a*–25*d*. The guide plate 21 may dispense with one or two of the position sensors 80*a*–80*d* so long as they can precisely detect whether the printed sheet P is in a state to be carried.

A rear cover 36 constituting a part of the sheet stacking unit 2 includes a stop 23, with which a leading edge of the printed sheet P present on the guide plate 21 strikes. The stop 23 is made from a sound absorbing material such as rubber or sponge so as to effectively reduce sound produced by the leading edge of the printed sheet P.

Further, the guide plate 21 includes a pair of side guides 26 along a part of the opposite side edges thereof. The side guides 26 are in parallel to the sheet guiding direction X, so that the opposite side edges of the printed sheet P come into contact with the side guides 26. Referring to FIG. 2, the side guides 26 have U-shaped cutaways 40 at their upper center portions so as to facilitate removal of the printed sheets P from the sheet receptacle 50. A distance C between the side guides 26 is slightly greater than a width B of the printed sheet P.

As shown in FIG. 3, the guide plate 21 extends to the vicinity of the stop 23. However, it is not always necessary that the guide plate 21 has such a length. Alternatively, the guide plate 21 may be shaped in any manner so long as it can reliably guide the printed sheet P to the spiral carriers 25*a*–25*d*.

A pair of shafts 24*a* and 24*c* to which the spiral carriers 25*a* and 25*c* are fixedly attached are positioned along one of the side edges of the guide plate 21. Similarly, a pair of shafts 24*b* and 24*d* are provided along the other side edge of the guide plate 21 so as to fixedly attach the spiral carriers 25*b* and 25*d*. Opposite ends of these shafts 24*a*–24*d* are rotatably received in bearings 27 which are attached to an upper plate 52 and a fixed plate 20. These plates 52 and 20 are attached to the casing of the sheet stacking unit 2. The shafts 24*a*–24*d* are made axially immovable by stops (not shown).

A distance A between the spiral carriers 25*c* and 25*d* and between the spiral carriers 25*a* and 25*b* is set to be smaller than the width B of the printed sheet P so that the opposite side edges of the printed sheet P are reliably supported by the pair of spiral carriers 25*c* and 25*d* and by the pair of spiral carriers 25*a* and 25*b*.

The spiral carriers 25*c*, 25*a* along one side edge of the guide plate 21 and the spiral carriers 25*d*, 25*b* along the other side edge have opposite winding directions, so that the printed sheet P present between adjacent coils 25*e* of the spiral carriers 25*a*–25*d* is moved in the direction so as to come into contact with the rear cover 36.

The coils 25*e* of the spiral carriers 25*a*–25*d* are preferably separated by a small space which reliably prevents the printed sheets P from being in contact with one another. This is advantageous for endowing the sheet stacking unit with a reduced height. However, printed sheets P may be jammed between coils 25*e* which are nearest the guide plate 21. To overcome this problem, a pitch R1 of such coils 25*e* is set to be larger than a pitch R2 of the other coils 25*e*.

The space between adjacent coils 25*e*, i.e. pitch R1 or R2, can be easily varied by deforming the spiral carriers 25*a*–25*d* in a longitudinal direction.

The driver 51 includes a pulse motor 29 and a mechanism for transmitting the power of the pulse motor 29 to the spiral carriers 25*a*–25*d*. The pulse motor 29 is connected to a power supply (not shown) via the controller 60.

Figure 4:
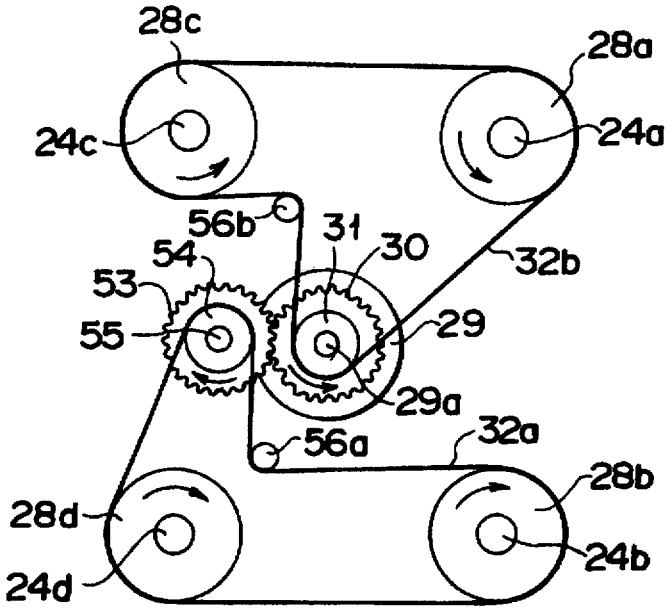
FIG. 4 is a schematic plan view of a power transmitting member of the sheet stacking unit.

As shown in FIGS. 2 and 4, the power transmitting mechanism includes pulleys 28*a*, 28*b*, 28*c* and 28*d*, a motor gear 30, a motor pulley 31, a belt 32b, a driven gear 53, a driven pulley 54, and a belt 32a. The pulleys 28a–28d are fixedly attached to the lower ends of the shafts 24a, 24b, 24c and 24d. The motor gear 30 and motor pulley 31 are fixedly coupled to an output shaft 29a of the pulse motor 29. The belt 32b extends over the pulleys 28a and 28c and the motor pulley 31. The driven gear 53 is engaged with the motor gear 30. The driven pulley 54 is supported on a shaft 55 where the driven gear 53 is fixedly attached. The belt 32a extends over the pulleys 28b and 28d and the driven pulley 54. In FIG. 4, reference numerals 56a and 56b denote idlers for adjusting tension applied to the belts 32a and 32b.

Following the counterclockwise rotation of the pulse motor 29 as shown in FIG. 4, the motor pulley 31, belt 32b, and pulleys 28a and 28b rotate in the same direction as that of the pulse motor 29. Thus, the spiral carriers 25c and 25a coupled to the shafts 24c and 24a also rotate counterclockwise. Concurrently with the counterclockwise rotation of the pulse motor 29, the driven gear 53 in engagement with the motor gear. 30 rotates clockwise, causing the clockwise rotation of the driven pulley 54, belt 32a, and pulleys 28d and 28b. The spiral carriers 25d and 25b coupled to the shafts 24d and 24b also rotate clockwise.

The spiral carriers 25c and 25d which confront each other via the guide plate 21 rotate in reverse directions. Similarly, the spiral carriers 25a and 25b rotate in reverse directions. These carriers 25a–25d rotate in such a manner as to bring the leading edge of the printed sheet P into contact with the rear cover 36 and to lift the printed sheet P toward the sheet receptacle 50. The printed sheet P held between adjacent coils 25e tends to shift laterally as a result of the rotation of the spiral carriers 25a–25d, but is moved upward with its leading edge being in contact with the rear cover 36.

The controller 60 is connected to the pulse motor 29, and controls the operation of the pulse motor 29 in response to a signal from the sensor 33. Each time the sensor 33 detects the presence of a printed sheet P, the controller 60 actuates the pulse motor 29, which rotates the spiral carriers 25a–25d once. Thus, the printed sheet P is lifted by a distance equal to the pitch of coils 25e of the spiral carriers 25a–25d.

Further, the controller 60 is connected to a print end switch 61, position sensors 80a, 80b, 80c and 80d, and a buzzer 62. The print end switch 61 is operated to stop the printing operation. The buzzer 62 notifies the operator of an abnormal state or malfunction of the sheet stacking unit 2. The buzzer 62 may be replaced with a lamp. Further, both the buzzer and lamp may be used together. In response to the operation of the print end switch 61, the controller 60 actuates the pulse motor 29, which rotates the spiral carriers 25a–25d the number of times equal to the number N of coils 25e. Thus, all the printed sheets P held between adjacent coils 25e are lifted toward the sheet receptacle 50.

The sheet stacking unit 2 is actuated by a power source which is separate from a power source of the stencil printing machine 1. The sheet stacking unit 2 is controlled independently of the printing machine when the printed sheet P is discharged from the stencil duplicating machine 1.

Referring to FIG. 3, the rear cover 36 is supported by a shaft 37a attached to a side plate 37 of the casing of the sheet stacking unit 2. The rear cover 36 is opened and closed via the shaft 37a, so that jammed sheets can be removed by opening the rear cover 36. As shown in FIG. 2, a semi-transparent acrylic resin cover 34 is supported by a shaft 35 over the upper plate 52. The cover 34 is opened and closed via the shaft 35. A printed sheet sensor 46 is attached on the cover 34 so as to detect a full state of the sheet receptacle 50, e.g. whether or not the sheet receptacle 50 has 100 to 150 printed sheets P therein. A signal output from this sensor 46 is supplied to the controller 60. The sensor 46 serves to prevent application of an excessive load to the pulse motor 29 when the sheet receptacle 50 is full, and also to prevent the printed sheets P from being subject to back transfer due to a weight thereof.

The sheet stacking unit 2 is placed on the printed sheet tray 17 of the stencil duplicating machine 1 by engaging a member 39 (shown in FIG. 2) with the positioning shaft 18 (shown in FIG. 1) of the stencil duplicating machine 1. Specifically, the member 39 is present on the underside of the guide plate 21, and has an inverted U-shaped groove 38 which is engageable with the positioning shaft 18 of the stencil duplicating machine 1.

Figure 5:
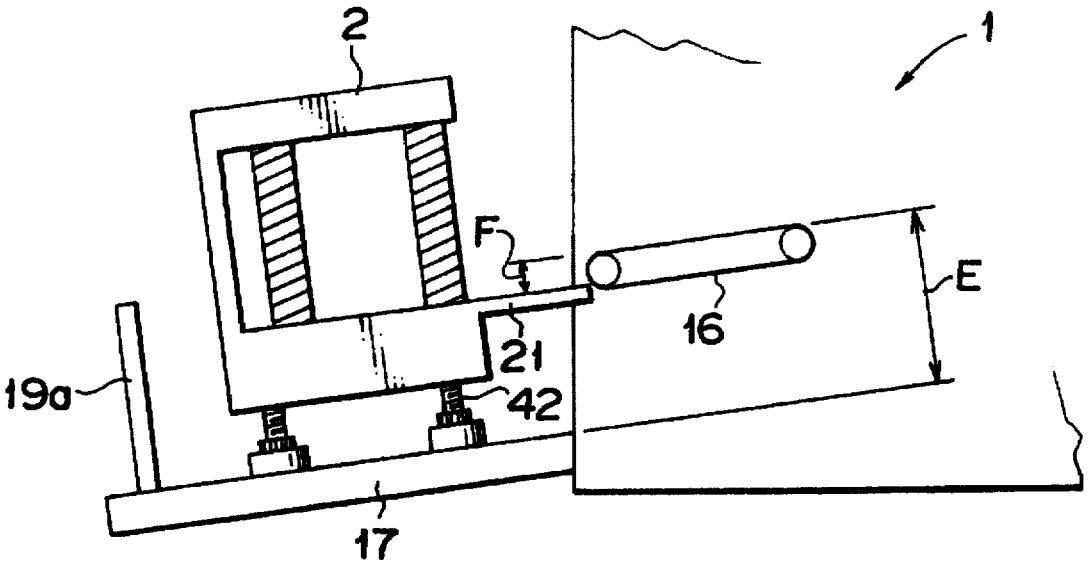
FIG. 5 is a side view showing legs of the sheet stacking unit.
Figure 6:
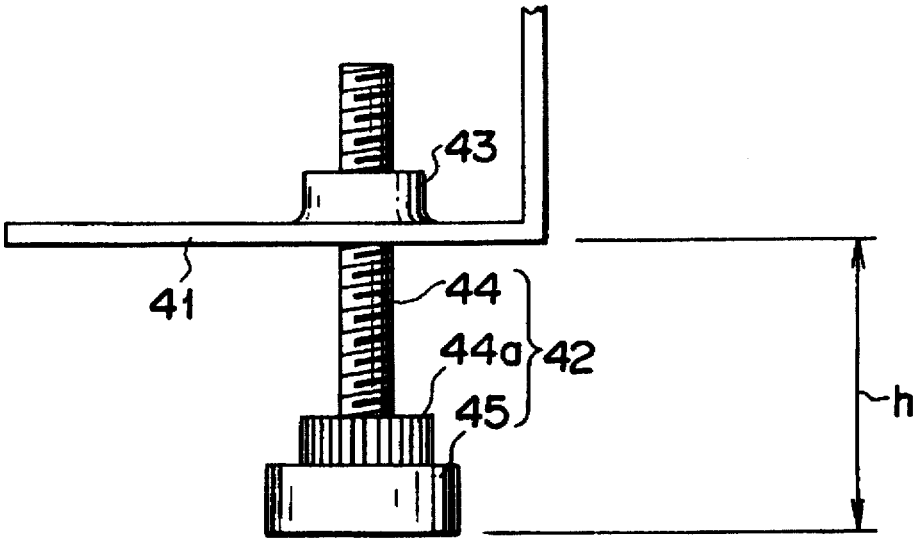
FIG. 6 is an enlarged view of the leg of FIG. 5.

A distance E between the printed sheet tray 17 and the printed-sheet feeding belts 16 varies according to the manufacturer or type of stencil duplicating machines 1. Therefore, it is required to precisely determine a difference F of height between the printed-sheet feeding belts 16 and the small-size sheet stacking unit 2 so as to guide the printed sheets P reliably. The smaller the difference F of height, the more frequently the printed sheets P collide with corners of the guide plate 21, and fail to successfully reach the stop 23. Conversely, if the difference F of height is great, the printed sheets P are not successfully supported between adjacent coils 25e of the spiral carriers 25c and 25d. To overcome this problem, four adjustable legs 42 are attached to a bottom plate 41 of the sheet stacking unit 2, as shown in FIG. 6. Each leg 42 includes a shaft 44 in engagement with a nut 43, a rubber block 45 attached at one end of the shaft 44, and a large diameter member 44a for rotating the shaft 44. A height h of the legs 42 is adjusted by manually turning the large diameter portion 44a. The legs 42 are shown only in FIGS. 5 and 6.

The operation of the sheet stacking unit 2 will be described hereinafter. It is assumed that one original image is printed on fifty postcards. First of all, the operator places the original image on a reader of the stencil duplicating machine 1. Next, the fifty postcards are set on the printing sheet feed tray 12 with several extra sheets of the postcard size placed thereon. These extra sheets are used for a stencil sticking process and for trial printing.

In the stencil duplicating machine 1, an end fence 19a and side fences 19 (both shown in FIG. 1) are widened to a maximum on the printed sheet tray 17. The sheet stacking unit 2 is placed on the tray 17 with the groove 38 of the member 39 engaged with the positioning shaft 18. Then, the legs 42 are respectively adjusted so as to make the height difference F a predetermined value.

When a power switch (not shown) of the sheet stacking unit 2 is turned on, the sheet stacking unit 2 becomes ready for receiving printed sheets P.

Then, a stencil perforation start key (not shown) is pressed on the stencil duplicating machine 1, so that the original image will be read by the reader, and perforated on a stencil by a thermal head. The perforated stencil is wrapped on an outer surface of the printing drum 11. Then, ink is applied to the stencil on the printing drum 11 so as to print the image onto an uppermost sheet. Thus, the stencil is stuck onto the printing drum 11 by ink. A first printed sheet is guided to the guide plate 21 by the printed-sheet feeding belts 16. The first printed sheet passes over the sensor 33, comes into contact with the stop 23, and stops moving. In this state, the opposite side edges of the first printed sheet are supported between adjacent coils 25e of the spiral carriers 25a, 25b, 25c and 25d.

When detecting the first printed sheet, the sensor 33 outputs a signal to the controller 60. The controller 60 actuates the pulse motor 29 after a predetermined period of time, e.g. 0.5 seconds. The pulse motor 29 rotates the carriers 25a–25d once, thereby lifting the first printed sheet by a distance equal to a space between adjacent coils 25e. If the first printed sheet happens to be guided to a position where it cannot be lifted, i.e. if any of the position sensors 80a–80d detects an abnormal state, the position sensors notify this state to the controller 60. Then, the controller 60 deactivates the pulse motor 29, and activates the buzzer 62 so as to notify the operator of the abnormal state.

The operator opens the rear cover 36 to remove the first printed sheet, and checks whether or not the image is precisely and accurately printed. If necessary, proof printing may be performed. When the first printed sheet and proof-printed sheets are acceptable, the extra postcard-size sheets will be removed from the printing sheet feed tray 12. Then, the print start key (not shown) will be activated so as to print the postcards. In this state, the postcards will be sequentially fed to the printing drum 11 so as to be printed. A printing speed may be variable between 60 to 120 postcards per minute in the stencil duplicating machine 1.

Each printed sheet P is guided by the guide plate 21, and is stopped in contact with the stop 23. Then, the opposite side edges of the printed sheet P are received and supported between adjacent coils 25e of the carriers 25a–25d. Each time a printed sheet P passes over the sensor 33, the sensor 33 provides the signal to the controller 60. As with the first printed sheet, the controller 60 actuates the pulse motor 29 in a predetermined time interval, e.g. 0.5 seconds, after receiving the signal from sensor 33. The pulse motor 29 rotates the carriers 25a–25d once, which lift the printed sheet P by the distance equal to the space between the adjacent coils 25e.

The foregoing operation is repeated until all of the fifty printed postcards are received in the sheet receptacle 50. When the sheet receptacle 50 becomes full of the printed sheets P, this state is detected by the printed sheet sensor 46, which outputs a signal to the controller 60. Thereafter, the controller 60 deactivates the pulse motor 29, and operates the buzzer 62 so as to notify the full state of the receptacle 50 to the operator.

Figure 7:
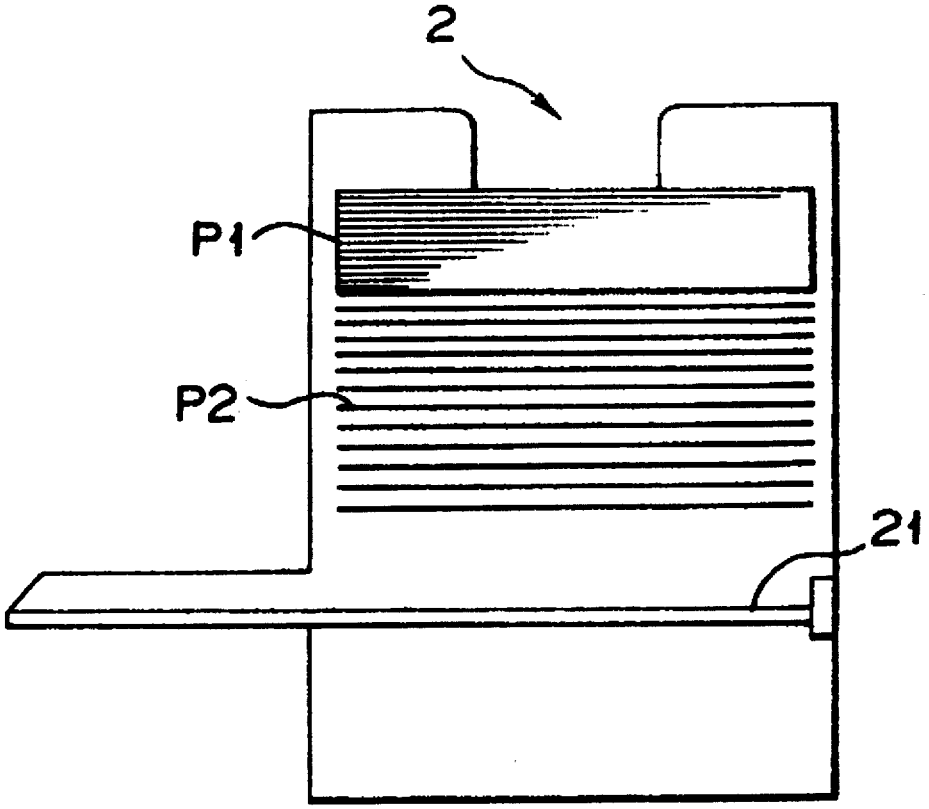
FIG. 7 shows a manner in which printed sheets are stacked in the sheet stacking unit.

When printing of the fifty postcards is completed before the printed postcards reach the sheet receptacle 50, approximately one half of the printed postcards P are stacked at the upper part of the spiral carriers 25a–25d. These postcards are designated by P1 in FIG. 7. The other half of the printed postcards rest between the coils 25e of the carriers 25a–25d. These postcards are designated by P2 in FIG. 7.

If further postcards are printed using a different original image, the printing operation will be repeated with the sheet stacking unit 2 held on the printed sheet tray 17.

When the printing operation is completed after printing the fifty postcards, the sheet stacking unit 2 will be detached from the printed sheet tray 17 by disengaging the engaging member 39 from the positioning shaft 18 of the stencil duplicating machine 1. Thereafter, the stencil duplicating machine 1 is usable for printing sheets of ordinary size.

When the print end switch 61 (shown in FIG. 2) is operated on the sheet stacking unit 2 removed from the printed sheet tray 17, a print end signal is input to the controller 60. Then, the controller 60 actuates the pulse motor 29, which intermittently rotates the carriers 25a–25d the number of times equal to the number N of coils 25e of the respective carriers 25a–25d, so that the printed sheets P2 will be moved upwards to the sheet receptacle 50, and stacked therein.

Figure 8:
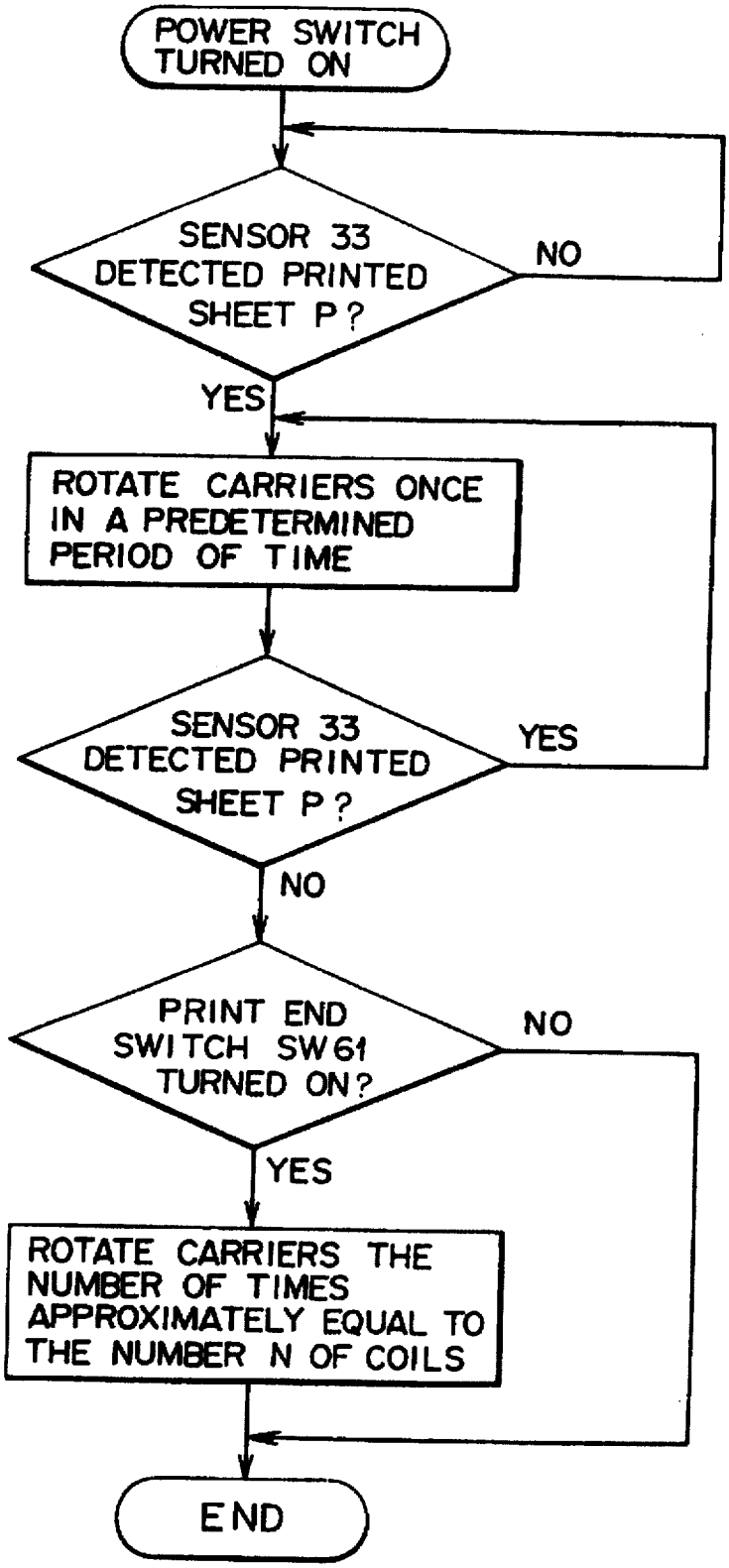
FIG. 8 is a flowchart showing the operation sequence of the sheet stacking unit.

By opening the rear cover 34, the printed sheets P will be easily removed from the sheet receptacle 50 via the cutaway 40 on the side guides 26. It is also possible to take the printed sheets P out from the sheet receptacle 50 by opening the rear cover 36. The foregoing operation is sequentially shown in FIG. 8.

The spiral carriers are advantageous in that they can simplify the sheet stacking unit as a whole and make the unit compact. Further, the spiral carriers are rotated an integer number of times including at least once for each printed sheet, which means that the controller can control the motor in a simple manner.

Figure 9:
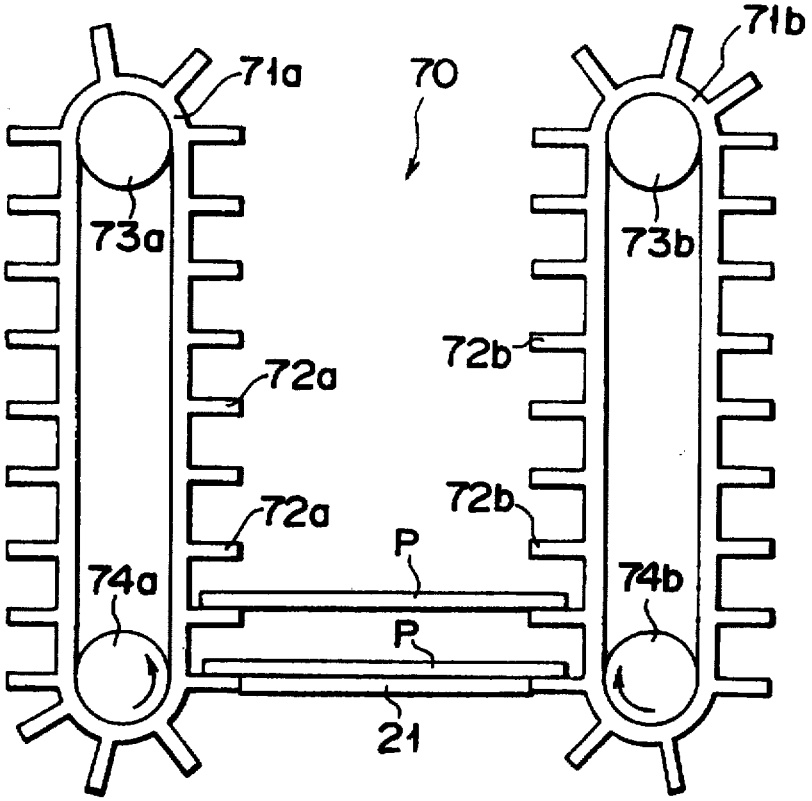
FIG. 9 is a front view showing another example of a carrier of the sheet stacking unit.

FIG. 9 shows a modified carrier 70. The carrier 70 mainly comprises a pair of drive pulleys 74a and 74b, a pair of driven pulleys 73a and 73b, a pair of toothed endless belts 71a and 71b, and a driver (not shown). The drive pulleys 74a and 74b are disposed in parallel to the direction for feeding the printed sheet P (i.e. in the direction perpendicular to the plane of FIG. 9) on the guide plate 21. The toothed endless belts 71a and 71b respectively extend over the pulleys 73a and 74a, and over the pulleys 73b and 74b. The toothed endless belts 71a and 71b include teeth 72a and 72b, respectively, so as to support the printed sheet P thereon. The driver rotates the drive pulleys 74a and 74b in the directions shown by arrows, respectively.

The teeth 72a and 72b are integral parts of the endless belts 71a and 72b, respectively. A space between tips of a pair of confronting teeth 72a and 72b is set to be smaller than the width of the printed sheet P, so that the opposite side edges of each printed sheet P are supported on the teeth 72a and 72b.

Referring to FIG. 9, a printed sheet P on the guide plate 21 is placed on a pair of confronting teeth 72a and 72b which are at the lowermost portion of the carrier 70. As with the spiral carriers 25a–25d, the driver is actuated by a controller (not shown) each time a printed sheet P is placed on confronting teeth 72a and 72b. The driver rotates the drive pulleys 74a and 74b intermittently, so that the printed sheet P is lifted by a distance equal to a space between adjacent teeth 72a (72b). In this manner, the printed sheets P on the teeth 72a and 72b are lifted toward the sheet receptacle 50.

In this embodiment, the controller 60 causes the spiral carriers 25a–25d to rotate once each time the sensor 33 detects a printed sheet P. Alternatively, the spiral carriers 25a–25d may be rotated twice or more times (integer times) following the detection of a printed sheet P.

Figure 10:
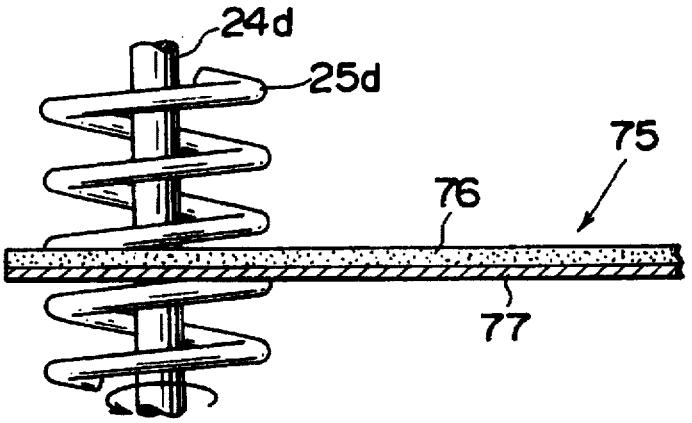
FIG. 10 is a side cross section showing how a cleaning sheet is held between adjacent holding members of the sheet stacking unit shown in FIG. 2.

If a printed sheet P is curved or corrugated, ink on such a printed sheet may partially stick onto the spiral carriers 25a–25d (shown in FIGS. 2 and 3) of the sheet stacking unit 2. It is probable that the ink-smeared spiral carriers may also smear subsequently printed sheets P. To overcome this problem, a cleaning sheet 75 is used to clean the ink-smeared carriers 25a–25d. An example of the cleaning sheet 75 is shown in FIG. 10 with only the spiral carrier 25d depicted.

The cleaning sheet 75 includes a base 77 and an ink-absorbing member 76 adhered to the base 77. The cleaning sheet 75 is as large as the printed sheet P, but is thicker than the printed sheet P. The ink-absorbing member 76 may be made from a material such as a water-absorbing paper, sponge or non-woven fabric. Thus, ink sticking on the carriers can be easily wiped off by the thick cleaning sheet 75.

The operator manually inserts the cleaning sheet 75 between adjacent coils 25e of the carriers 25a–25d with the ink-absorbing member 76 facing up. Then, the print end switch 61 (FIG. 2) is depressed so as to rotate the carriers 25*a*–25*d* the number times substantially equal to the number N of coils 25*e*. Thus, the carriers 25*a*–25*d* will be cleaned.

A second embodiment of the invention will be described with reference to FIG. 11. This embodiment differs from the first embodiment in that the stencil printing machine 1 includes a sensor for detecting unsuccessful feeding of printed sheets (called "printed-sheet sensor" hereinafter), and that the sheet stacking unit 2 includes a signal generator.

Figure 13:
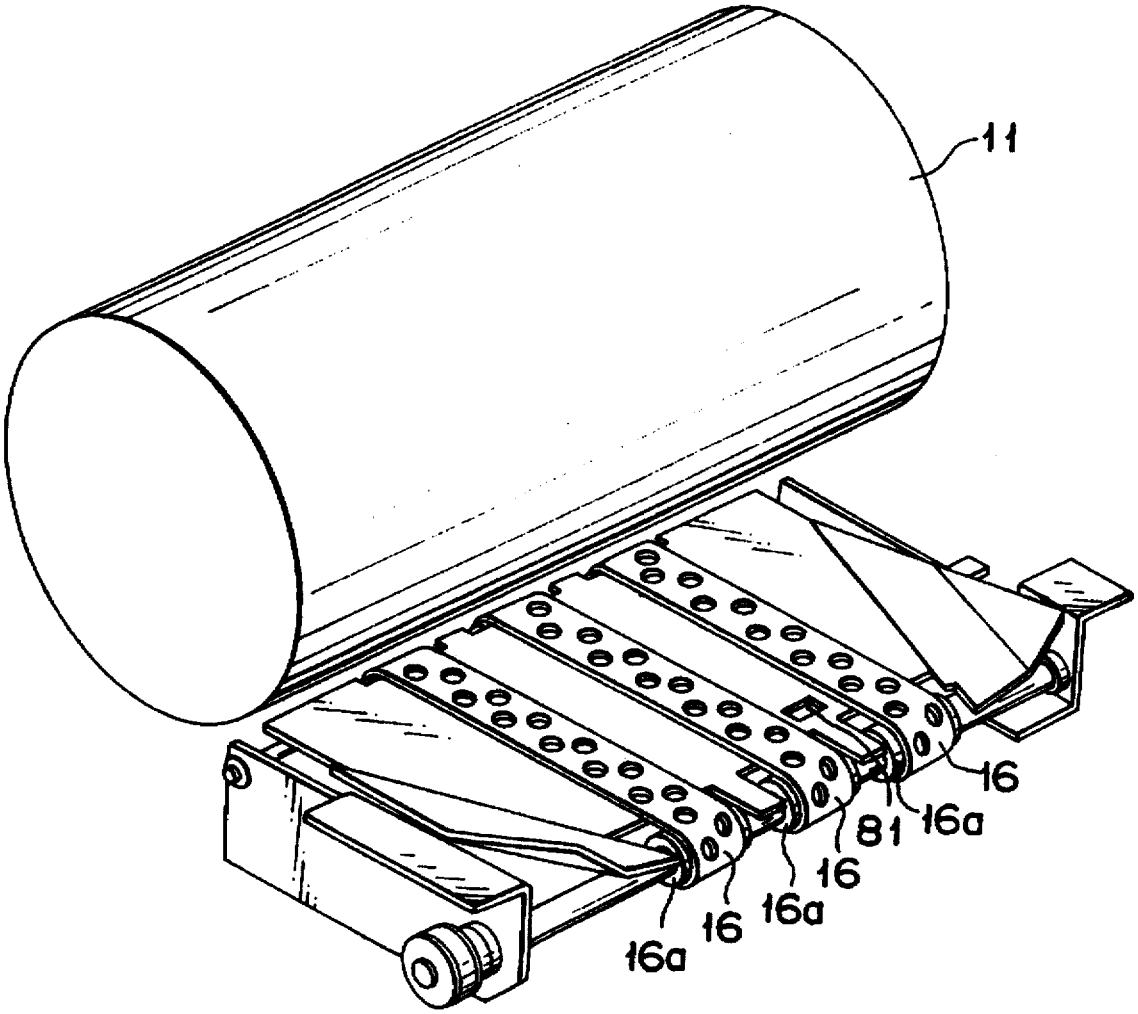
FIG. 13 is a perspective view showing a main part of a printed sheet discharging part of a stencil printing machine.

Referring to FIG. 13, a plurality of printed sheet feeding belts 16 extend, with predetermined spaces kept therebetween, over drive and driven rollers 16*a* and 16*b*. The belts 16 have a great number of pores so as to suck the printed sheet P thereto. An optical sensor 81 as the printed-sheet sensor is disposed at a predetermined position between adjacent belts 16. The optical sensor 81 is a well-known reflection type sensor, which has a light emitting portion and a light receiving portion. The sensor 81 is connected to the controller 90 of the stencil duplicating machine 1.

The optical sensor 81 detects whether or not a printed sheet P passes over the printed-sheet feeding belts 16 within a predetermined time interval after the printing drum 11 starts printing. The printed sheets P are determined to be fed normally when they pass over the belts 16 within the predetermined time interval. On the contrary, if passage of a printed sheet P over the belts 16 is not detected within the predetermined time interval, or if a printed sheet P stays on the optical sensor 81, the printed sheet P is not recognized as having been successfully fed.

Figure 11:
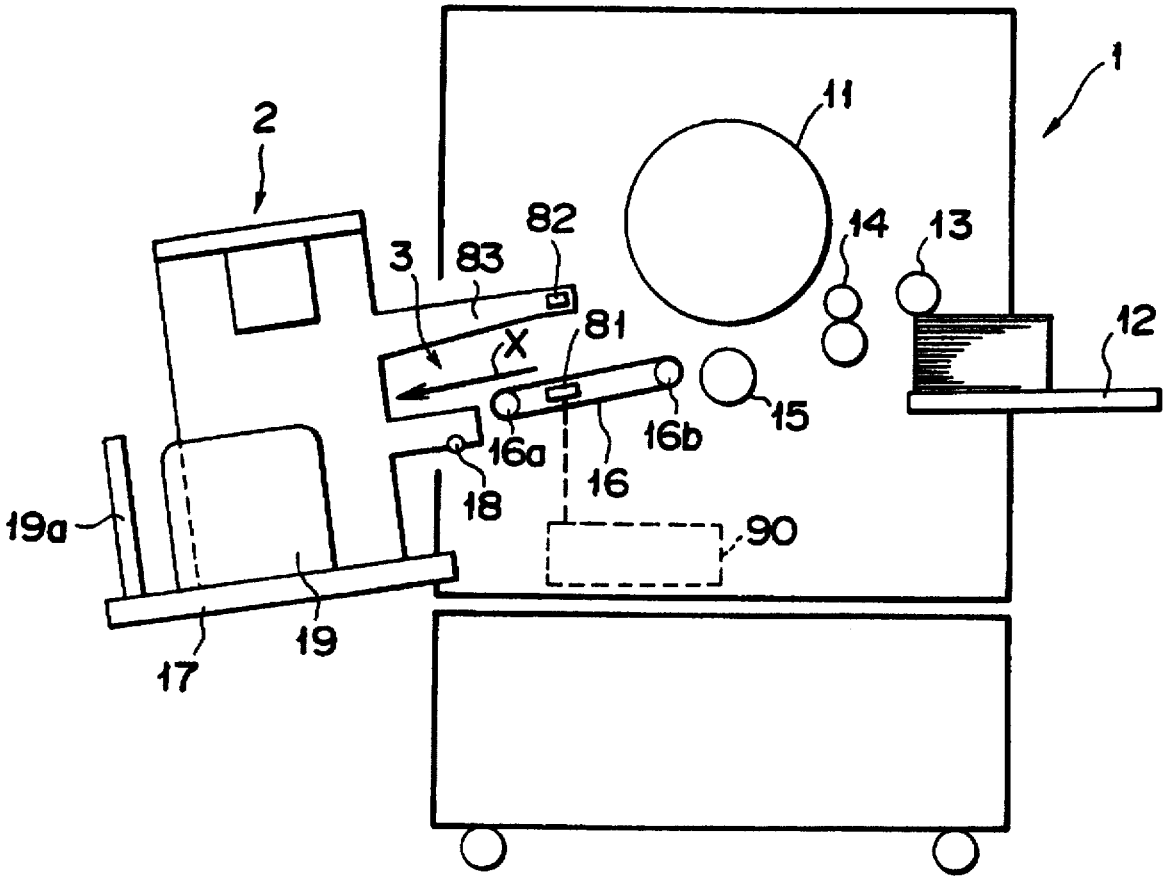
FIG. 11 is a schematic side view showing a sheet stacking unit according to a second embodiment of the invention.

Referring to FIG. 11, the sheet feeding unit 2 includes the signal generator, i.e. light emitting unit 82. The light emitting unit 82 is positioned at one end of a support 83, which extends in a direction X from the casing, and is above the guide plate 21. The light emitting unit 82 has a light emitting portion similar to that of the optical sensor 81 (of the stencil duplicating machine 1), and is positioned such that it can emit light over a relatively wide area. The light emitting unit 82 is connected to the controller 60, which controls the light emitting unit 82. The support 83 has a length which is adjustable so as to let the light emitting unit 82 confront the optical sensor 81 when the sheet stacking unit 2 is placed on the printed sheet tray 17 by engaging the member 39 with the positioning shaft 18 of the printing machine 1.

In an alternative arrangement, the support 83 may be dispensed from the sheet stacking unit 2. In such a case, the light emitting unit 82 may be attached, using a double-sided adhesive tape or a magnet, at an appropriate position so as to confront the optical sensor 81 in the stencil duplicating machine 1. The light emitting unit 82 is connected to the controller 60 at one end and to the optical sensor 81 at the other end via a flexible signal wire. The double-sided adhesive tape or magnet is attached to the light emitting unit 82.

The light emitting unit 82 as the signal generator emits light as a signal. Alternatively, the signal generator may generate a signal in the form of magnetism or ultrasonic waves. It should be noted that when the optical sensor 81 of the light reflection type is used, the light emitting unit 82 should have a light emitting member compatible with such a sensor. On the other hand, when the printed sheet sensor is responsive to magnetism or ultrasonic waves, the signal generator should be of type compatible with such a sensor.

The sheet stacking unit 2 of this embodiment operates in a similar manner to that described with respect to the first embodiment. This embodiment differs from the first embodiment with respect to the optical sensor 81 and the light emitting unit 82, which will be described hereinafter.

Figure 12:
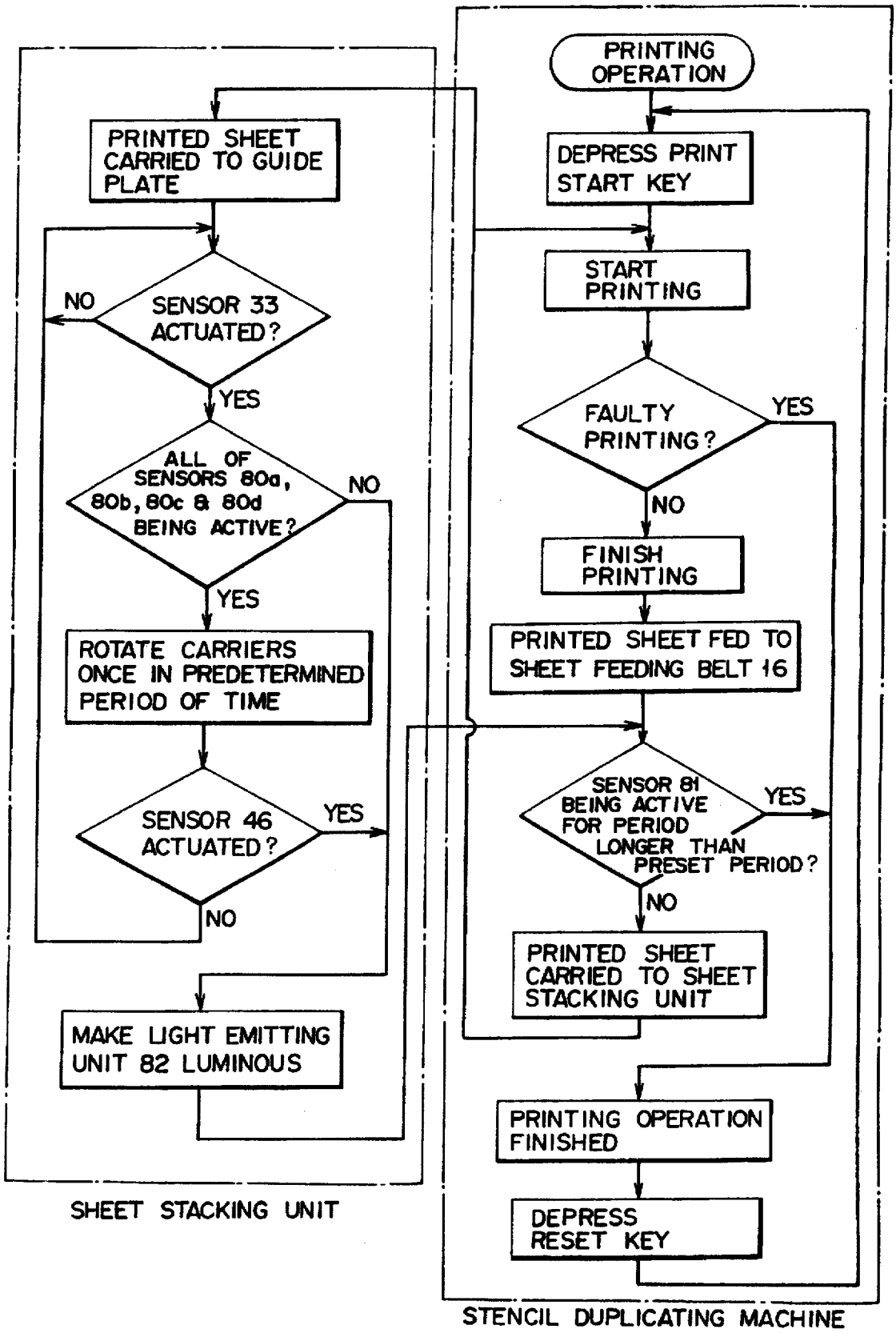
FIG. 12 is a flowchart showing the operation sequence of the sheet stacking unit of the second embodiment.

Postcards are sequentially printed by the stencil duplicating machine 1, and are received in the sheet stacking unit 2. If any printed postcard is detected to be in a position where it cannot be delivered to the sheet receptacle 50, or when the sheet receptacle 50 is recognized to be full, the position sensors 80*a*, 80*b*, 80*c* and 80*d* or the printed sheet sensor 81 provide a signal to the controller 60 of the sheet stacking unit 2. Then, the controller 60 not only deactuates the pulse motor 29 but also lets the light emitting unit 82 emit light to the optical sensor 81 for a predetermined time interval. In response to the optical signal, the optical sensor 81 outputs a signal to the controller 90 of the stencil duplicating machine 1. The controller 90 recognizes that the postcard is not successfully carried, and stops the printing operation. In this case, the sheet stacking unit 2 automatically stops the printing machine 1, so that the buzzer 62 may be not be provided. The foregoing operation sequence is shown in FIG. 12.

The small-size-sheet stacking unit of the present invention can be easily attached and detached to and from a printing machine. The sheet stacking unit sequentially carries printed sheets from the printing machine with a predetermined space kept between the printed sheets. Thus, it is possible to keep the printed sheets free from back transfer. The printed sheets can be removed from the sheet receptacle with ease.

When a printed sheet is not recognized to be at a position where the sheet is ready to be carried by the sheet stacking unit, or when the sheet receptacle is found to be full, the sheet stacking unit provides the printing machine with a signal indicative of such a state. In response to the signal, the printing machine stops operating. Thus, the operator is not always required to watch the printing machine and the sheet stacking unit.

Further, since use of non-contact type sensors does not require the connection of the sheet stacking unit and the printing machine with a mechanical harness, the sheet stacking unit can be attached to and detached from the printing machine without difficulty. Thus, the sheet stacking unit is applicable to any type of existing printing machine having a printed sheet sensor. In such a case, no mechanical or electrical modification is required to the sheet stacking unit or the printing machine.

What is claimed is:

1. A small-size-sheet stacking unit capable of being disposed on a printed sheet tray of a printing machine, comprising:

(a) a guide plate for guiding a printed sheet discharged onto the printed sheet tray;

(b) a plurality of carriers for carrying the printed sheet guided by the guide plate, the carriers including holding portions for holding opposite side edges of the printed sheet, the holding portions being longitudinally arranged with a predetermined space therebetween;

(c) driving means for driving the carriers so that one actuation of the carriers carries the printed sheet held by a group of said holding portions by a distance equal to the space between adjacent holding portions; and (d) a sheet receptacle for receiving the printed sheet carried by the carriers;

wherein the stacking unit is operationally associated with a control means for controlling the driving means, the control means controlling the driving means so as to rotate the carriers a number of times which is substantially equal to a number of the holding portions in response to a signal indicative of an end of the printing operation.

2. The small-size-sheet stacking unit according to claim 1, and wherein the carriers are spiral members standing straight and hold the printed sheets between adjacent holding portions thereof at at least three positions, the driving means includes a motor and a power transmission member for transmitting a rotational force of the motor, and the control means controls the driving means in such a manner as to intermittently rotate the carriers each time a printed sheet is discharged from the printing machine.

3. The small-size-sheet stacking unit according to claim 2, further comprising a rear cover for receiving a leading edge of the printed sheet, and wherein the carriers are rotated in a direction to move the printed sheet thereon upwards and to push the printed sheet toward the rear cover.

4. The small-size-sheet stacking unit according to claim 2 or 3, wherein the holding portions of the carriers are coils.

5. The small-size-sheet stacking unit according to claim 2 or 3, wherein a pitch of each holding portion where the printed sheet is first received is greater than a pitch of the other holding portions.

6. The small-size-sheet stacking unit according to claim 2 or 3, further comprising a casing for housing the carriers and the sheet receptacle, and legs for adjusting a height of the casing, the legs being attached to a bottom plate of the casing.

7. A cleaning sheet for use with the small-size-sheet stacking unit according to claim 1, the cleaning sheet being capable of removing ink sticking on the carriers, comprising an ink-absorbing material on at least one surface, and being substantially as large as the printed sheet.

8. A small-size-sheet stacking unit capable of being disposed on a printed sheet tray of a printing machine, comprising:

(a) a guide plate for guiding a printed sheet discharged onto the printed sheet tray;

(b) a plurality of carriers for carrying the printed sheet guided by the guide plate, the carriers including holding portions for holding opposite side edges of the printed sheet, the holding portions being longitudinally arranged with a predetermined space therebetween;

(c) position detecting means for detecting whether or not the printed sheet is fed to a position where the sheet is ready to be carried by the carriers;

(d) driving means for moving the carriers such that the carriers carry the printed sheet on the holding portions by a distance equal to at least one predetermined space between adjacent holding portions each time the position detecting means detects a presence of a printed sheet at the position where the sheet is ready to be carried by the carriers; and (e) a sheet receptacle for receiving the printed sheet carried by the carriers;

wherein the stacking unit is operationally associated with a control means for controlling the driving means, the control means controlling the driving means so as to rotate the carriers a number of times which is substantially equal to a number of the holding portions in response to a signal indicative of an end of the printing operation.

9. A small-size-sheet stacking unit for use with a printing machine which includes a printed sheet sensor for detecting abnormal sheet feeding and automatically stops operating in response to a first signal from said printed sheet sensor indicative of an abnormal sheet feeding state, and receives the sheet stacking unit on a printed sheet tray thereof, the small-size-sheet stacking unit comprising:

(a) a guide plate for guiding a printed sheet discharged onto the printed sheet tray;

(b) a plurality of carriers for carrying the printed sheet guided by the guide plate, the carriers including holding portions for holding opposite side edges of the printed sheet, the holding portions being longitudinally arranged with a predetermined space therebetween;

(c) position detecting means for detecting whether or not the printed sheet is fed to a position where the sheet is ready to be carried by the carriers and generating a second signal indicative thereof;

(d) driving means for moving the carriers such that the carriers carry the printed sheet on the holding portions by a distance equal to at least one predetermined space between adjacent holding portions;

(e) a sheet receptacle for receiving the printed sheet carried by the carriers; and (f) signal generating means for generating a signal in response to one of said first signal from said printed sheet sensor indicative of abnormal printed sheet feeding and said second signal from said position detecting means indicative of said printed sheet not being fed to a position where the sheet is ready to be carried by the carriers, and providing the signal to the printed sheet sensor for automatically stopping operating of the printing machine.

10. A small-size-sheet-stacking unit for use with a printing machine which includes a first printed sheet sensor detecting abnormal sheet feeding and automatically stops operating in response to a first signal from said first printed sheet sensor indicative of an abnormal sheet feeding state, and receives the sheet stacking unit on a printed sheet tray thereof, the small-size-sheet stacking unit comprising:

(a) a guide plate for guiding a printed sheet discharged onto the printed sheet tray;

(b) a plurality of carriers for carrying the printed sheet guided by the guide plate, the carriers including holding portions for holding opposite side edges of the printed sheet, the holding portions being longitudinally arranged with a predetermined space therebetween;

(c) position detecting means for detecting whether or not the printed sheet is fed to a position where the sheet is ready to be carried by the carriers;

(d) driving means for moving the carriers such that the carriers carry the printed sheet on the holding portions by a distance equal to at least one predetermined space between adjacent holding portions;

(e) a sheet receptacle for receiving the printed sheet carried by the carriers;

(f) a second printed sheet sensor for detecting a full state of the sheet receptacle and providing a second signal indicative thereof; and (g) signal generating means for generating a signal in response to the second signal from the second printed sheet sensor indicative of a full state of the sheet receptacle and providing the signal to the first printed sheet sensor to automatically stop operation of the printing machine.

11. A small-size-sheet stacking unit for use with a printing machine which includes a first printed sheet sensor for detecting an abnormal sheet feeding state, automatically stops operating in response to a first signal from said printed sheet sensor indicative of the abnormal sheet feeding state, and receives the sheet stacking unit on a printed sheet tray thereof, the small-size-sheet stacking unit comprising:

(a) a guide plate for guiding a printed sheet discharged onto the printed sheet tray;

(b) a plurality of carriers for carrying the printed sheet guided by the guide plate, the carriers including holding portions for holding opposite side edges of the printed sheet, the holding portions being longitudinally arranged with a predetermined space therebetween;

(c) position detecting means for detecting whether or not the printed sheet is fed to a position where the sheet is ready to be carried by the carriers and providing a second signal indicative thereof;

(d) driving means for moving the carriers such that the carriers carry the printed sheet on the holding portions by a distance equal to at least one predetermined space between adjacent holding portions;

(e) a sheet receptacle for receiving the printed sheet carried by the carriers;

(f) a second printed sheet sensor for detecting a full state of the sheet receptacle and providing a third signal indicative thereof; and (g) signal generating means for generating a signal in response to the one of said third signal from said second printed sheet sensor indicative of a full state of the sheet receptacle or said second signal from the position detecting means indicating that the printed sheet is not fed to the position where it is ready to be carried by the carriers and providing the signal to the first printed sheet sensor to automatically stop operation of the printing machine.

12. The small-size-sheet, stacking unit according to claim 10 or 11, wherein the first printed sheet sensor comprises a non-contact type sensor which transmits and receives signals on a non-contact basis.

13. The small-size-sheet stacking unit according to claim 9, wherein the printed sheet sensor comprises a non-contact type sensor which transmits and receives signals on a non-contact basis.

* * * * *

UNITED STATES PATENT AND TRADEMARK OFFICE

CERTIFICATE OF CORRECTION

PATENT NO. : 5,667,213

DATED : September 16, 1997

INVENTOR(S) : Hiroaki CHIDA, ET AL.

It is certified that error appears in the above-identified patent and that said Letters Patent is hereby corrected as shown below:

Column 5, line 20, change "gear." to --gear--.

Column 10, line 18, change "may be not" to --may not--.

Signed and Sealed this

Twelfth Day of May, 1998

*Attest:*

*Attesting Officer*

BRUCE LEHMAN

*Commissioner of Patents and Trademarks*